US008776543B2

(12) United States Patent
Wiggs

(10) Patent No.: US 8,776,543 B2
(45) Date of Patent: Jul. 15, 2014

(54) DX SYSTEM INTERIOR HEAT EXCHANGER DEFROST DESIGN FOR HEAT TO COOL MODE

(75) Inventor: B. Ryland Wiggs, Franklin, TN (US)

(73) Assignee: Earth to Air Systems, LLC, Franklin, TN (US)

( * ) Notice: Subject to any disclaimer, the term of this patent is extended or adjusted under 35 U.S.C. 154(b) by 912 days.

(21) Appl. No.: 12/992,046

(22) PCT Filed: May 14, 2009

(86) PCT No.: PCT/US2009/044006

§ 371 (c)(1),
(2), (4) Date: Dec. 30, 2010

(87) PCT Pub. No.: WO2009/140532

PCT Pub. Date: Nov. 19, 2009

(65) Prior Publication Data

US 2011/0100588 A1 May 5, 2011

Related U.S. Application Data

(60) Provisional application No. 61/053,097, filed on May 14, 2008.

(51) Int. Cl.
*F25D 21/06* (2006.01)

(52) U.S. Cl.
USPC ..... 62/260; 62/278

(58) Field of Classification Search
USPC ..... 62/151, 156, 159, 160, 196.4, 222, 260, 62/278
See application file for complete search history.

(56) References Cited

U.S. PATENT DOCUMENTS

| | | | |
|---|---|---|---|
| 2,503,456 | A | 4/1950 | Smith |
| 3,099,140 | A | 7/1963 | Leimbach |
| 3,183,675 | A | 5/1965 | Schroeder |
| 3,452,813 | A | 7/1969 | Watkins et al. |
| 3,986,345 | A | 10/1976 | Pilz et al. |
| 4,010,731 | A | 3/1977 | Harrison |
| 4,094,356 | A | 6/1978 | Ash et al. |
| 4,169,554 | A | 10/1979 | Camp |
| 4,182,133 | A | 1/1980 | Haas et al. |
| 4,189,848 | A | 2/1980 | Ko et al. |
| 4,224,805 | A | 9/1980 | Rothwell |
| 4,257,239 | A | 3/1981 | Partin et al. |
| 4,286,651 | A | 9/1981 | Steiger et al. |
| 4,290,266 | A | 9/1981 | Twite et al. |
| 4,325,228 | A | 4/1982 | Wolf |
| 4,375,831 | A | 3/1983 | Downing, Jr. |
| 4,378,787 | A | 4/1983 | Fleischmann |
| 4,383,419 | A | 5/1983 | Bottum |
| 4,392,531 | A | 7/1983 | Ippolito |
| 4,448,237 | A | 5/1984 | Riley |

(Continued)

*Primary Examiner* — Cheryl J Tyler
*Assistant Examiner* — Jonathan Bradford
(74) *Attorney, Agent, or Firm* — Miller, Matthias & Hull LLP

(57) ABSTRACT

A DX heating/cooling system includes an automatic hot gas by-pass valve (1) for preventing frosting of an interior heat exchanger/air handler (6) when the system is switched from the heating mode to the cooling mode, and a specially sized TXV (7) by-pass line (12), where the automatic hot gas by-pass valve (1) is positioned to provide hot gas at two optional locations, with one location before the cool liquid enters the air handler (6), and with the other location after the warmed vapor refrigerant exits the air handler (6).

26 Claims, 2 Drawing Sheets

(56) References Cited

U.S. PATENT DOCUMENTS

| | | | | |
|---|---|---|---|---|
| 4,448,238 | A | | 5/1984 | Singleton et al. |
| 4,459,752 | A | | 7/1984 | Babcock |
| 4,536,765 | A | | 8/1985 | Kaminski |
| 4,538,673 | A | | 9/1985 | Partin et al. |
| 4,544,021 | A | | 10/1985 | Barrett |
| 4,688,392 | A | * | 8/1987 | Fujimoto et al. ..... 62/174 |
| 4,700,550 | A | | 10/1987 | Rhodes |
| 4,715,429 | A | | 12/1987 | Mogensen |
| 4,741,388 | A | | 5/1988 | Kuroiwa |
| 4,798,056 | A | | 1/1989 | Franklin |
| 4,858,679 | A | | 8/1989 | Sakaya et al. |
| 4,858,694 | A | | 8/1989 | Johnson et al. |
| 4,867,229 | A | | 9/1989 | Mogensen |
| 4,936,110 | A | | 6/1990 | Kuckens |
| 4,993,483 | A | | 2/1991 | Harris |
| 5,025,634 | A | | 6/1991 | Dressler |
| 5,025,641 | A | | 6/1991 | Broadhurst |
| 5,029,633 | A | | 7/1991 | Mann |
| 5,038,580 | A | | 8/1991 | Hart |
| 5,054,297 | A | | 10/1991 | Furuhama |
| 5,062,276 | A | | 11/1991 | Dudley |
| 5,105,633 | A | | 4/1992 | Briggs |
| 5,131,238 | A | | 7/1992 | Meckler |
| 5,136,855 | A | | 8/1992 | Lenarduzzi |
| 5,199,486 | A | | 4/1993 | Balmer et al. |
| 5,207,075 | A | | 5/1993 | Gundlach |
| 5,224,357 | A | | 7/1993 | Galiyano et al. |
| 5,272,879 | A | | 12/1993 | Wiggs |
| 5,275,008 | A | | 1/1994 | Song et al. |
| 5,277,032 | A | | 1/1994 | See et al. |
| 5,313,804 | A | | 5/1994 | Kaye |
| 5,381,672 | A | | 1/1995 | Haasis |
| 5,383,337 | A | | 1/1995 | Baker |
| 5,388,419 | A | | 2/1995 | Kaye |
| 5,419,135 | A | | 5/1995 | Wiggs |
| 5,461,876 | A | | 10/1995 | Dressler |
| 5,477,703 | A | | 12/1995 | Hanchar et al. |
| 5,477,914 | A | | 12/1995 | Rawlings |
| 5,533,355 | A | | 7/1996 | Rawlings |
| 5,560,220 | A | | 10/1996 | Cochran |
| 5,561,985 | A | | 10/1996 | Cochran |
| 5,564,282 | A | | 10/1996 | Kaye |
| 5,598,887 | A | | 2/1997 | Ikeda et al. |
| 5,622,057 | A | | 4/1997 | Bussjager et al. |
| 5,623,986 | A | | 4/1997 | Wiggs |
| 5,651,265 | A | | 7/1997 | Grenier |
| 5,671,608 | A | * | 9/1997 | Wiggs et al. ..... 62/260 |
| 5,706,888 | A | | 1/1998 | Ambs et al. |
| 5,725,047 | A | | 3/1998 | Lopez |
| 5,738,164 | A | | 4/1998 | Hildebrand |
| 5,758,514 | A | | 6/1998 | Genung et al. |
| 5,771,700 | A | | 6/1998 | Cochran |
| 5,816,314 | A | | 10/1998 | Wiggs et al. |
| 5,875,644 | A | | 3/1999 | Ambs et al. |
| 5,934,087 | A | | 8/1999 | Watanabe et al. |
| 5,937,665 | A | | 8/1999 | Kiessel et al. |
| 5,937,934 | A | | 8/1999 | Hildebrand |
| 5,941,238 | A | | 8/1999 | Tracy |
| 5,946,928 | A | | 9/1999 | Wiggs |
| 6,012,294 | A | * | 1/2000 | Utsumi ..... 62/81 |
| 6,138,744 | A | | 10/2000 | Coffee |
| 6,212,896 | B1 | | 4/2001 | Genung |
| 6,227,003 | B1 | | 5/2001 | Smolinsky |
| 6,276,438 | B1 | | 8/2001 | Amerman et al. |
| 6,354,097 | B1 | | 3/2002 | Schuster |
| 6,390,183 | B2 | | 5/2002 | Aoyagi et al. |
| 6,450,247 | B1 | | 9/2002 | Raff |
| 6,521,459 | B1 | | 2/2003 | Schooley et al. |
| 6,615,601 | B1 | | 9/2003 | Wiggs |
| 6,751,974 | B1 | | 6/2004 | Wiggs |
| 6,789,608 | B1 | | 9/2004 | Wiggs |
| 6,892,522 | B2 | | 5/2005 | Brasz et al. |
| 6,931,879 | B1 | | 8/2005 | Wiggs |
| 6,932,149 | B2 | | 8/2005 | Wiggs |
| 6,971,248 | B1 | | 12/2005 | Wiggs |
| 7,080,524 | B2 | | 7/2006 | Wiggs |
| 7,146,823 | B1 | | 12/2006 | Wiggs |
| 7,191,604 | B1 | | 3/2007 | Wiggs |
| 7,234,314 | B1 | | 6/2007 | Wiggs |
| 7,401,641 | B1 | | 7/2008 | Wiggs |
| 7,578,140 | B1 | | 8/2009 | Wiggs |
| 7,591,145 | B1 | | 9/2009 | Wiggs |
| 7,832,220 | B1 | | 11/2010 | Wiggs |
| 7,841,200 | B1 | | 11/2010 | Wiggs |
| 2002/0132947 | A1 | | 9/2002 | Smith et al. |
| 2002/0194862 | A1 | | 12/2002 | Komatsubara |
| 2004/0000399 | A1 | | 1/2004 | Gavula |
| 2004/0129408 | A1 | | 7/2004 | Wiggs |
| 2004/0206103 | A1 | | 10/2004 | Wiggs |
| 2006/0086121 | A1 | | 4/2006 | Wiggs |
| 2006/0096309 | A1 | | 5/2006 | Wiggs |
| 2007/0074847 | A1 | | 4/2007 | Wiggs |
| 2007/0089447 | A1 | | 4/2007 | Wiggs |
| 2007/0151280 | A1 | | 7/2007 | Wiggs |
| 2008/0016894 | A1 | | 1/2008 | Wiggs |
| 2008/0173425 | A1 | | 7/2008 | Wiggs |
| 2009/0065173 | A1 | | 3/2009 | Wiggs |
| 2009/0095442 | A1 | | 4/2009 | Wiggs |
| 2009/0120120 | A1 | | 5/2009 | Wiggs |
| 2009/0120606 | A1 | | 5/2009 | Wiggs |
| 2009/0133424 | A1 | | 5/2009 | Wiggs |
| 2009/0260378 | A1 | | 10/2009 | Wiggs |
| 2009/0272137 | A1 | | 11/2009 | Wiggs |

* cited by examiner

DX SYSTEM INTERIOR HEAT EXCHANGER DEFROST DESIGN FOR HEAT TO COOL MODE

CROSS-REFERENCE TO RELATED APPLICATION

This is the National Stage of International Application No. PCT/US2009/044006, filed May 14, 2009, which claims the benefit of U.S. Provisional Application No. 61/053,097, filed May 14, 2008.

FIELD OF THE DISCLOSURE

This disclosure generally relates to geothermal direct exchange ("DX") heating/cooling systems, which are also commonly referred to as "direct expansion" heating/cooling systems. More particularly, this disclosure relates to means for resolving potential icing/frosting of an interior heat exchanger when the system is switched from a heating mode to a cooling mode.

BACKGROUND OF THE DISCLOSURE

Geothermal ground source/water source heat exchange systems typically include fluid-filled closed loops of tubing buried in the ground, or submerged in a body of water, which either absorb heat from or to reject heat into the naturally occurring geothermal mass and/or water surrounding the tubing. The tubing loop is extended to the surface and is then used to circulate the naturally warmed or cooled fluid to an interior air heat exchanger.

Common and older design geothermal water-source heating/cooling systems typically circulate, via a water pump, a fluid comprised of water, or water with anti-freeze, in plastic (typically polyethylene) underground geothermal tubing so as to transfer geothermal heat to or from the ground in a first heat exchange step. Via a second heat exchange step, a refrigerant heat pump system is utilized to transfer heat to or from the water. Finally, via a third heat exchange step, an interior air handler (comprised of finned tubing and a fan) is utilized to transfer heat to or from the refrigerant to heat or cool interior air space.

More recent geothermal heat exchange systems, known as direct exchange (or "DX") systems, submerge the refrigerant transport lines below the surface, thereby eliminating one of the heat exchange steps noted above. The refrigerant transport lines in direct exchange systems are typically formed of copper and circulate a refrigerant fluid such as R-22, R-407C, R-410a, or the like. In a first heat exchange step, the refrigerant transport lines directly transfer geothermal heat to or from the sub-surface elements. Heat is transferred to or from an interior air space, typically using an interior air handler, in a second heat exchange step. Consequently, DX systems are generally more efficient than water-source systems because less heat exchange steps are required and because no water pump energy expenditure is necessary. Further, since copper is a better heat conductor than most plastics, and since the refrigerant fluid circulating within the copper tubing generally has a greater temperature differential with the surrounding ground than the water circulating within the plastic tubing, a direct exchange system generally requires less excavation and drilling, and therefore less installation costs, than a water-source system.

While most DX heat exchange designs are feasible, various improvements have been developed intended to enhance overall system operational efficiencies. Several such improvements, particularly in direct expansion/direct exchange geothermal heat pump systems, are taught in U.S. Pat. No. 5,623,986 to Wiggs; in U.S. Pat. No. 5,816,314 to Wiggs, et al.; in U.S. Pat. No. 5,946,928 to Wiggs; and in U.S. Pat. No. 6,615,601 B1 to Wiggs, the disclosures of which are incorporated herein by reference. Such disclosures encompass both horizontally and vertically oriented sub-surface heat geothermal heat exchanger.

SUMMARY OF THE DISCLOSURE

Techniques and designs are disclosed to enhance and improve at least one of the efficiency, the longevity, and the interior comfort levels of a DX system when switching from the heating mode to the cooling mode, when refrigerant temperatures within the interior refrigerant heat exchange tubing is at or below a freezing temperature of water.

More specifically, an improved means is provided for operating DX systems switching from the heating mode to the cooling mode at the end of a heating season when the ground is cold and the refrigerant within the interior heat exchanger is at or below the freezing temperature of water. Under such conditions, it may be difficult to obtain full design refrigerant flow and frost may develop on the interior refrigerant transport tubing, thereby reducing operational efficiencies of the system. Additionally, a means is disclosed for providing full or near full refrigerant flow. Still further, a means for preventing "frosting" of the interior refrigerant transport heat exchange tubing in a DX system when changing from the heating mode to the cooling mode is described herein.

All heat pump systems use expansion devices in the heating and cooling modes. Typical expansion devices include fixed orifice pin restrictors and automatic, self-adjusting expansion devices, commonly referred to as "TXVs" or "TEVs." Expansion devices are used to lower the pressure and temperature of the circulating refrigerant fluid, thereby to increase the ability of the fluid to absorb heat by providing a greater temperature differential. In DX systems, a unique problem is encountered in moderate to cold climates when switching from the heating mode to the cooling mode at the end of a heating season. Namely, testing has shown that the ground immediately surrounding the sub-surface, heat transfer, refrigerant transport tubing is sometimes very cold (at or below approximately 50 degrees Fahrenheit, or "F"), and the heat transfer fluid (a refrigerant) circulating within the tubing can exit the ground at temperatures at or below approximately 50 degrees F., which nearby surrounding ground has had heat removed all winter.

When the refrigerant exiting the ground is at or below approximately 50 degrees F., it may drop to a temperature of 32 degrees F. or lower when it passes through an expansion device with the system operating in the cooling mode. Consequently, humidity in the air may condense on the interior heat exchange refrigerant tubing and subsequently freeze, thereby frosting the interior heat exchange refrigerant tubing. This accumulation of frost or ice can significantly reduce interior heat exchange abilities until the refrigerant exiting the ground has sufficiently warmed above approximately 50 degrees F., plus or minus approximately 5 degrees F. The ground may be warmed naturally and/or by absorbing waste heat during system operation in the cooling mode. Further, when the ground is very cold (near or below approximately 50 degrees F.), the refrigerant in the sub-surface heat exchanger tends to collect and remain in the coldest area of the system, thereby increasing the difficulty of obtaining design refrigerant flow rates for optimum system performance.

Thus, supplemental heat may be provided to the interior heat exchanger in such situations, to melt any frost or ice accumulating at the interior heat exchanger and to maintain a higher compressor discharge heat level to the sub-surface environment to more quickly raise the temperature of the sub-surface environment. Such supplemental heat may be supplied by a heat source external to the system (such as a fossil fuel, electric, solar, or the like, heat supply) or by a heat source internal to the system, such as heat from the high pressure/warm refrigerant side of the heat pump. Heat from the high pressure side of the system could come from the high pressure and warm refrigerant fluid exiting the interior heat exchanger or from the hot gas vapor refrigerant exiting a compressor or an oil separator (if supplied).

Extensive testing has demonstrated, however, that the amount of supplemental heat should be controlled to increase system efficiency. If too little supplemental heat is provided, frosting of the interior heat exchange tubing and excessively low-pressure suction operational conditions will persist. On the other hand, if too much supplemental heat is provided, the ability to effectively cool the interior air or liquid is impaired or lost, since optimum or adequate heat exchange temperature differential is lost, and the working temperature of the compressor may rise to an unsafe level, potentially resulting in compressor shut down or burnout.

Therefore, a means of supplying the appropriate amount of supplemental heat to the refrigerant transport tubing within the interior heat exchanger may incorporate a temperature and/or a pressure sensor which may be used to engage the supplemental heat supply when the temperature of the refrigerant within the interior heat exchanger/air handler is at or below the freezing temperature of water, and to disengage the supplemental heat supply when the temperature of the refrigerant exiting the ground reaches about 50 degrees F. Further, such a supplemental heat assembly may engage to keep the temperature of the refrigerant entering the interior heat exchanger at a temperature that is at least approximately 1 degree F. above freezing, prior to the supplemental heat means (such as a special hot gas by-pass valve) disengaging when the temperature of the refrigerant exiting the ground reaches about 50 degrees F. Otherwise, the compressor's suction line superheat and/or the compressor's discharge hot gas temperature can become too high.

In such a design, the supplemental heat may be provided at one of two points. A first point is in the liquid refrigerant transport line past the cooling mode expansion device, but prior to the refrigerant actually entering the interior heat exchanger/air handler refrigerant transport tubing (which would typically be at a point immediately prior to the liquid refrigerant tubing distributor to the interior heat exchanger). A second point would be at a point in the vapor refrigerant transport line exiting the air handler, but prior to the refrigerant entering the system's accumulator and compressor.

Such supplemental heat may be supplied via a valve that automatically opens to permit hot gas/vapor refrigerant from the compressor and/or warm refrigerant fluid exiting the interior heat exchanger to provide supplemental heat to the refrigerant at one of the above-noted points, and that automatically closes when the temperature of the refrigerant exiting the sub-surface geology reaches approximately 50 degrees F. Supplemental heat from the hot gas refrigerant may have a higher temperature differential than heat from the interior heat exchanger, and therefore may be advantageous in some applications.

Supplemental heat may be supplied to the refrigerant exiting the interior heat exchanger, but at a point before the accumulator, by a hot gas by-pass valve because such supplemental heat increases the back pressure and temperature of the refrigerant itself within the interior heat exchanger which, in turn, maintains the temperature of the refrigerant within the interior heat exchanger at a point above freezing, thereby eliminating the frosting problem. Such a supplemental hot gas by-pass valve heating means is well known in the refrigeration art field, where hot gas by-pass valves routinely supply small portions of hot gas to refrigerant lines exiting heat exchangers to provide back pressure and eliminate frosting on freezers. Such hot gas by-pass valves, as an example, are manufactured by the Sporlan Division of the Parker Hannifin Corporation, of 206 Lange Drive, Washington, Mo..

The use of a hot gas by-pass valve alone, however, will not provide both optimal combined increased refrigerant flow abilities when the ground is cold (at or below about 50 degrees F.) and interior heat exchanger defrosting abilities in a DX system. Further, such hot gas by-pass valves alone, absent pressure settings for a DX system application developed and discussed herein, will not optimize results. Instead, to optimize unique results when one switches from the heating mode to the cooling mode in a DX system, such valves may have special and specific pressure settings and may be used in conjunction with an expansion device by-pass, comprised of a TXV by-pass line or a TXV bleed port, when TXVs or other expansion devices (such as pin restrictors, or the like), are used as the cooling mode expansion device for the interior heat exchanger.

The drawings herein depict supplemental heat supplied to the interior heat exchanger (herein depicted as an air handler) from a smaller secondary refrigerant hot gas line exiting the primary hot gas discharge line side of the system. The smaller secondary hot gas line exits the high pressure side of the DX system at a point downstream of the compressor and oil separator (if supplied) but upstream of the sub-surface heat exchange tubing (which operates as a condenser in the cooling mode). The automatic hot gas by-pass valve disclosed herein may be provided with hot gas exiting an oil separator, and an oil separator that is at least 98% efficient may be incorporated into the system design. Such an arrangement avoids sending hot gas directly from the compressor into the automatic valve, which may deliver too much oil and potentially impair the valve's best mode of operation.

In a DX system application, a TXV cooling mode expansion device may lower the temperature of the refrigerant fluid entering the interior heat exchanger/air handler by approximately 10 to 20 degrees F. It would be well understood by those skilled in the art that differing expansion devices could have differing temperature drop ranges (and corresponding pressure drop ranges) other than approximately 10-20 degrees F. In such event, the problem addressed herein would apply to any situation were the refrigerant traveling into the interior air handler, or other heat exchanger, was at or below the freezing point of water.

Thus, a means of both more quickly increasing the refrigerant flow rate to a full design flow rate, when full design refrigerant flow is otherwise impaired because of a very cold sub-surface environment tending to "keep" the refrigerant in the coldest location, and increasing the temperature of the refrigerant within the interior heat exchanger to a point above freezing is desirable during such a heating to cooling mode transition period.

Proprietary testing has demonstrated that, in a DX system application, a specially designed hot gas by-pass valve may be used in conjunction with a TXV with a sufficiently sized bleed port or a TXV with a specially designed and opened by-pass line around the TXV, when in the cooling mode of system operation. This arrangement ensures adequate refrigerant flow and eliminates interior heat exchanger frosting when the system is switched from the heating mode to the cooling mode when the sub-surface ground temperatures is at or below approximately 50 degrees F. Both the specially designed hot gas by-pass valve and the specially designed TXV by-pass means may be utilized in conjunction with one another to simultaneously solve both problems unique to a DX system. The use of only one of the specially designed hot gas by-pass valve and the specially designed TXV by-pass means will not optimally address both the problems of inadequate refrigerant fluid flow from the sub-surface heat exchanger and interior heat exchanger frosting. Extensive testing has shown that both the specially designed hot gas by-pass valve and the specially designed TXV, with at least one of a bleed port and a by-pass means, may be used together to resolve the unique problems encountered by a DX system application.

The hot refrigerant gas/vapor by-pass refrigerant transport line may have an interior diameter no greater than the size of the liquid refrigerant transport line between the compressor unit and the air handler. Such a liquid line is typically a ⅜ inch O.D., refrigerant grade, type L, copper line for 1 to 2-5 ton system designs, and a ½ inch O.D., refrigerant grade, type L, copper line for 2.6 to 5 ton system designs, for example. However, such a liquid line may be no smaller than half the size of the liquid refrigerant transport line size between the compressor and the interior air handler.

The automatic hot gas by-pass valve ("AV") may include a pressure sensing cap and both a hot gas supply line and a pressure sensor/equalizer line extending from the AV to a point that is at least approximately two inches, and in some applications at least approximately twelve inches, downstream of the AV's hot gas supply point. The term "downstream" is used herein to indicate that it is in the direction of refrigerant flow. The AV valve's equalizer line senses the temperature and/or the pressure of the supplementally heated refrigerant fluid traveling into or out of the interior heat exchanger/air handler.

When the hot refrigerant gas/vapor by-pass line extends to, and operably connects with, the liquid refrigerant transport line at a point past the air handler's TXV, but before the liquid line distributor, when at least one of an R-410A and an R-407C refrigerant is utilized, an AV may be installed within the hot gas by-pass line that begins to close off the by-pass line when approximately 75 psi is reached within the equalizer line, and that modulates to fully close off the hot gas by-pass line at a point when approximately 95 psi is reached in the equalizer line. Such an AV may have a pressure sensitive cap filled with dry nitrogen gas at a pressure of approximately 85 psi, plus or minus approximately 5 psi, to offset the valve spring adjustment when the valve, if adjustable, is equivalent to the valve identified below, with the valve's adjustable screw/nut, at the below identified valve's base, screwed in fully clockwise. A suitable valve, but with approximately 85 psi of dry nitrogen in its pressure sensitive cap (which valve and cap and adjustable screw/nut are well understood by those skilled in the art), would be a Sporlan Valve HGBE-5-95/115, as manufactured by the Sporlan Division of the Parker Hannifin Corporation, of 206 Lange Drive, Washington, Mo. 63090. Other valves may be utilized that have the same operational equivalencies.

Detailed testing has shown that if a cap pressure setting of approximately 85 psi (plus or minus approximately 5 psi) is higher (then being too high), there will be no cooling effect as too much hot gas is being sent through the interior heat exchanger, and both the compressor's superheat and discharge temperature will be too high. On the other hand, and if a cap pressure setting of about 85 psi (plus or minus approximately 5 psi) is lower (then being too low), too little refrigerant is permitted to by-pass the TXV and therefore excessive frost/ice will build-up within the interior heat exchanger, so as to inhibit heat exchange with the interior air, and too little refrigerant circulation occurs within the sub-surface geothermal heat exchange tubing.

However, testing has indicated that, when utilizing R-410A or R407C refrigerant, when the hot refrigerant gas/vapor by-pass line extends to and operably connects with a supply point that is past the interior heat exchanger/air handler refrigerant's vapor line exit point, but before the accumulator, an AV may be installed within the hot gas by-pass line that begins to close off the by-pass line when approximately 90 psi is reached within the equalizer line, and that modulates to fully close off the by-pass line at a point when approximately 102 psi is reached in the equalizer line (which will be at the approximate point where the temperature of the refrigerant exiting the sub-surface geology/ground reaches about 50 degrees F.). Such an AV may have a pressure sensitive cap filled with dry nitrogen gas at a pressure of approximately 110 psi to offset the valve spring adjustment when the valve, if adjustable, is equal, or equivalent, to the valve identified below, with the adjustable screw/nut at the base of the below identified valve example screwed in fully clockwise. A suitable valve, but with approximately 110 psi, of dry nitrogen in its pressure sensitive cap, for example, would be a Sporlan Valve HGBE-5-95/115, as manufactured by the Sporlan Division of the Parker Hannifin Corporation, of 206 Lange Drive, Washington, Mo. 63090. Other valves may be utilized that have the same operational equivalencies.

When a refrigerant other than R-410A or R-407C is utilized, the psi pressure setting of the valve cap may be appropriately adjusted to accomplish the same approximate results of keeping the interior of the air handler warm enough to prevent frosting, and so as to disengage the AV when the refrigerant temperature exiting the ground reaches approximately 50 degrees F. Regardless of the location of the AV and regardless of refrigerant type, the AV's equalizer line may be at least approximately two, and in certain applications at least approximately twelve, inches downstream of the AV's hot refrigerant gas input connection point into or out of the interior heat exchanger.

In the alternative, at least one of an electronically operated valve, with pre-determined settings, and a solenoid valve could be utilized in lieu of the automatically operating hot gas by-pass valve ("AV") described herein. The electronic valve or solenoid valve, however, would add an electronic component to a DX system, thereby increasing the complexity of the system and adding component failure risks, thereby potentially impairing the optimum durability of the DX system design. Should an electronic valve or a solenoid valve be used as the hot-gas by-pass valve, the respective valve settings may be designed to operate within the herein disclosed design parameters.

The specially sized TXV by-pass means may be provided as a TXV bleed port or a TXV by-pass line. A TXV bleed port is well understood by those skilled in the art, although the bleed port size for a DX system would have an equivalent refrigerant flow rate as herein described for a TXV by-pass line containing a pin restrictor, which TXV bleed port size, for use in conjunction with a specially sized hot gas by-pass valve for a DX system, is believed to have not been previously known or disclosed.

A TXV by-pass line, for use in conjunction with the above-described hot gas by-pass automatic valve design, may be comprised of a refrigerant transport line of no larger a size than the liquid refrigerant transport line between the compressor and interior air handler, and no smaller than half that size, and may have a pin restrictor (or the equivalent thereof), within pin restrictor housing, within the TXV by-pass line, which TXV by-pass line transports refrigerant fluid around the primary cooling mode TXV itself (although not around the TXV's capillary tube connection to the vapor line exiting the interior heat exchanger). The pin restrictor' rounded orifice, which orifice is within the center of the pin restrictor, which pin restrictor is within the TXV by-pass line, may be sized as per the following formula:

A rounded orifice size, or the equivalent thereof, with an area of approximately 0.000082 square inches per 1,000 BTUs of system compressor capacity size in BTUs, where 12,000 BTUs equal one ton of compressor capacity size (not system capacity size), plus or minus approximately 10%.

As it is well known that refrigerant flow rates through a pin restrictor orifice are somewhat different than through a TXV bleed port, the flow rate through a TXV bleed port may be designed to be approximately equal to the flow rate, as described in detail herein, for the desired flow rate through the orifice of a pin restrictor.

Thus, whenever the at least one of a bleed port through a TXV and a TXV by-pass line with a pin restrictor provides/comprises a passageway that allows of a flow of liquid refrigerant at least one of through and around the cooling mode expansion device (a TXV or other cooling mode expansion device), the passageway size may be the equivalent of an orifice/hole that is sized by multiplying approximately 0.000082 square inches times the system design tonnage in thousands, where one ton equals 12,000 BTUs.

When a TXV bleed port is utilized for the TXV by-pass means, the hot gas supplied via the specially designed hot gas by-pass valve may be supplied automatically after the extra refrigerant fluid (the extra refrigerant fluid exiting the sub-surface heat exchanger and traveling through the bleed port in the TXV) has already been introduced into the refrigerant fluid traveling into the interior heat exchanger.

However, when a TXV by-pass line is utilized, in conjunction with the specially sized pin restrictor orifice, the extra refrigerant fluid (the extra refrigerant fluid exiting the sub-surface heat exchanger and traveling through the by-pass line around the TXV) may be introduced at least approximately two inches upstream of the introduction of hot gas refrigerant supplied via the specially designed automatic hot gas by-pass valve.

Alternately, in lieu of utilizing a hot gas by-pass valve in conjunction with at least one of a TXV with a bleed port and a TXV with a by-pass line containing a pin restrictor with a specially sized internal orifice, testing has indicated a design that is potentially more advantageous. Namely, when the automatic hot gas by-pass valve, as disclosed herein, is used in conjunction with a TXV by-pass line (sized as disclosed herein), the TXV by-pass line may be left fully open, with no pin restrictor and with no other refrigerant flow restriction whatsoever. Testing has shown that using the full by-pass line flow rate, the hot gas provided by the automatic hot gas valve is sufficiently tempered to keep most, or all, of the ice off the interior air handler's finned heat exchange tubing, while keeping both the compressor suction line superheat temperature lower and the compressor discharge temperature lower.

More specifically, testing has evidenced that full flow through the TXV, while not absolutely mandatory, keeps the superheat at the compressor (superheat at the compressor's suction line) about 6 degrees lower, and keeps the compressor discharge temperature about 10 degrees lower, than utilizing at least one of the TXV bleed port and the pin restrictor in the TXV by-pass line, as described hereinabove. Thus, full flow through the TXV by-pass line may improve operational efficiency, but may also require an extra valve to shut off the full flow once the refrigerant flow exiting the sub-surface heat exchanger reaches about 50 degrees F., which extra valve may, or may not, be worth installing, depending on system design conditions. Such an extra valve may be comprised of a solenoid valve, a pressure sensitive cut-off valve, a temperature sensitive valve, or the like.

The other advantage of utilizing a temporary full refrigerant flow through the TXV by-pass line (without any restriction) is that the cooling mode air temperature differentials within the interior air handler are effected at a somewhat accelerated rate over, and are initially about several degrees greater than, that of a design utilizing at least one of a bleed port through a TXV, and a TXV with a TXV by-pass line with a pin restrictor in the by-pass line. Thus, for commercial system designs, for example, a full refrigerant flow through an unrestricted TXV by-pass line design, with an extra valve within the by-pass line to fully cut off the refrigerant flow within the by-pass line once the refrigerant exiting the ground reached a temperature of about 50 degrees F., may be provided.

As explained, in order to optimize normal system operational efficiencies in the cooling mode, when refrigerant temperatures exiting the ground have warmed up above the approximate 50 degree F. range, the full and unrestricted TXV by-pass line should be closed. Closing the TXV by-pass line, after such conditions are reached, may be accomplished via at least one of a solenoid valve, a pressure valve, and a temperature valve, or the like, which are designed to fully block the flow of refrigerant through the TXV by-pass line when refrigerant temperatures, exiting the sub-surface environment in the cooling mode, exceed approximately 50 degrees F.

When using a TXV with an unrestricted TXV by-pass line in conjunction with a hot gas by-pass valve, testing has demonstrated the pressure setting in the hot gas by-pass valve cap may be set at approximately 85 psi, plus or minus approximately 5 psi.

Further, whenever a hot gas by-pass valve is used in a DX reverse-cycle system, a safety check valve may be installed within the hot gas by-pass line so as to prevent any unwanted reverse direction refrigerant flow through any potential slight leak in the hot gas by-pass valve when the system is operating in the heating mode (with the refrigerant flowing in a reverse direction from that in the cooling mode), which otherwise could significantly impair system operational efficiencies. A safety check valve may be installed within the primary hot-gas by-pass valve's hot gas supply line to help prevent any such unwanted occurrence.

DETAILED DESCRIPTION

The following detailed description is of the best presently contemplated mode of carrying out the subject matter disclosed herein. The description is not intended in a limiting sense, and is made solely for the purpose of illustrating the general principles of this subject matter. The various features and advantages of the present disclosure may be more readily understood with reference to the following detailed description taken in conjunction with the accompanying drawings.

Figure 1:
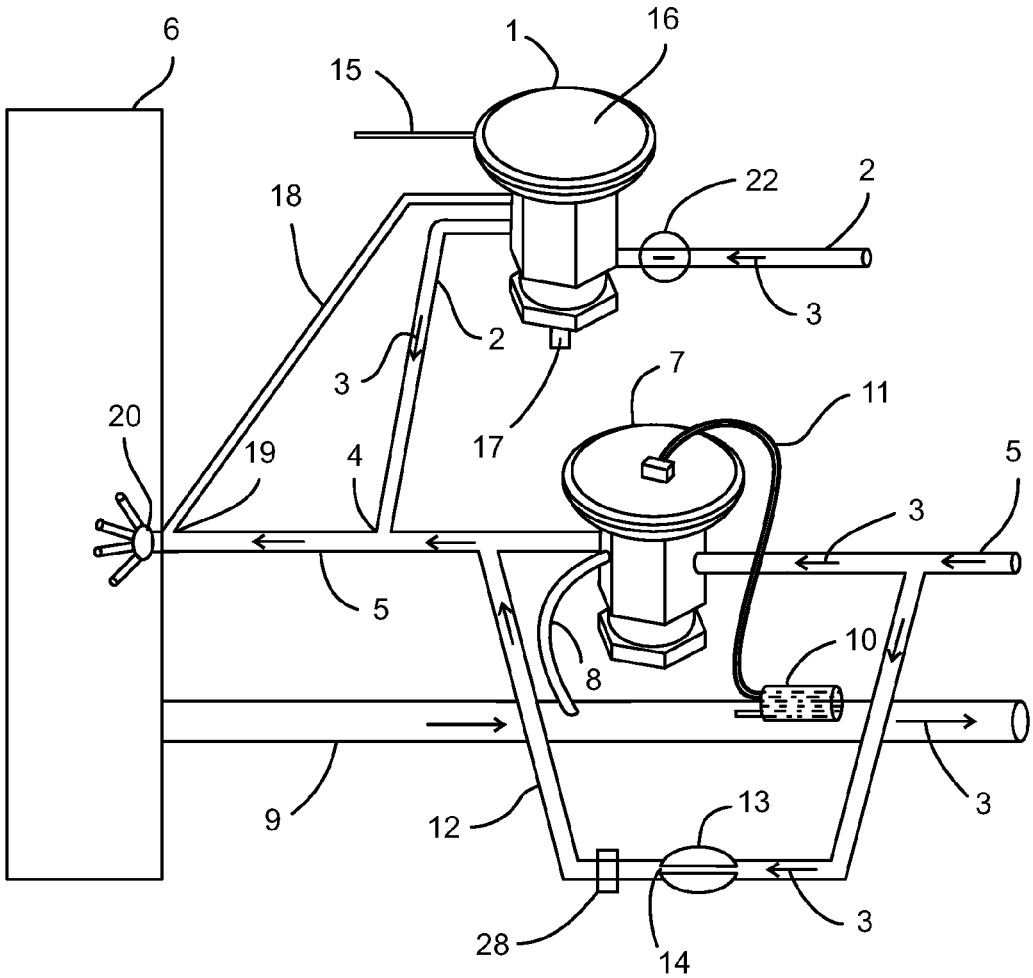
FIG. 1 is a side view of a partial DX geothermal heating/cooling system, primarily showing an interior air handler, refrigerant transport lines, and valves, incorporating primary automatic valve, TXV, and TXV by-pass according to the present disclosure where hot gas is introduced into the liquid refrigerant transport line after the TXV, but before the liquid line distributor to the air handler.

Referring now to the drawings, FIG. 1 illustrates a side view of an automatic self-adjusting hot gas by-pass valve 1 (also referred to as an "AV") that is situated in a smaller hot gas by-pass refrigerant transport line 2. The hot gas by-pass line 2 carries refrigerant (which flows in the direction of arrows 3 when the system is in the cooling mode) originating from a compressor (not shown) to the automatic valve 1. The size of the hot gas by-pass line 2 is no larger than that of a liquid refrigerant transport line 5 extending between the compressor and the interior heat exchanger 6, and is no smaller than half the size of the liquid refrigerant transport line 5.

A check valve 22 (shown here in an open position in the cooling mode of system operation) is shown as situated in the hot gas by-pass line 2 between the compressor and the AV 1, which provides a backup for preventing refrigerant flow through the hot gas by-pass line 2 when the system is operating in the heating mode, although the AV 1 itself would normally prevent such flow. In the cooling mode, the refrigerant 3 traveling through the hot gas by-pass line 2 travels through the AV 1, which automatically meters the flow of the hot gas for delivery, at a low pressure line delivery point 4 into the primary low pressure and cool liquid refrigerant transport line 5 entering the interior heat exchanger 6 (herein shown as an air handler).

Additionally, a thermostatically controlled self-adjusting expansion valve 7 (also known as a "TEV" or a "TXV") is disposed in the primary cool liquid refrigerant transport line 5. In a DX system operating in the cooling mode, the primary cool liquid refrigerant transport line 5 carries refrigerant 3 coming from the sub-surface heat exchanger (not shown herein as DX system sub-surface heat exchangers are well understood by those skilled in the art), which sub-surface heat exchanger acts as a condenser in the cooling mode. The cool liquid refrigerant transport line 5 carries cool liquid refrigerant both to the TXV 7 and to a pin restrictor 13 situated within a cool liquid refrigerant by-pass line 12. After passing through the TXV 7 and pin restrictor 13, the pressure and temperature of the refrigerant 3 within the cool refrigerant transport line 5 is reduced, and the refrigerant is thereafter transported to an interior heat exchanger 6 by means of the continuing primary low pressure liquid refrigerant transport line 5. The refrigerant 3 absorbs heat within the interior heat exchanger 6 and is then transported out of the interior heat exchanger 6 by means of a primary warm vapor refrigerant transport line 9 to an accumulator (not shown) and then to the compressor.

The TXV 7 has a TXV equalizer line 8, which is attached to and senses pressure in the primary warm vapor refrigerant transport line 9 exiting the interior heat exchanger 6. The TXV 7 also has a temperature sensing bulb 10, which bulb 10 is also operably connected to the primary warm vapor refrigerant transport line 9 exiting the interior heat exchanger 6, via a connecting line 11 to the TXV 7.

A cool liquid refrigerant by-pass line 12 by-passes the TXV 7. The cool liquid refrigerant by-pass line 12 contains a pin restrictor 13 with a central orifice 14 for metering refrigerant flow through the cool liquid refrigerant by-pass line 12. The central orifice 14 is sized to have a cross-sectional area of approximately 0.000082 square inches per 1,000 BTUs of system compressor capacity size in BTUs, where 12,000 BTUs equal one ton of compressor capacity size.

A TXV 7 can also be constructed with an internal bleed port that permits refrigerant to continuously flow through the TXV 7. Whenever the bleed port through the TXV 7 or the TXV by-pass line 12 with a pin restrictor 13 provides a passageway for refrigerant flow through or around the cooling mode TXV 7 expansion device (an expansion device can be a TXV 7 or other cooling mode expansion device), the passageway size may be the equivalent of an orifice/hole 14 that is sized by multiplying approximately 0.000082 square inches times the system design tonnage in thousands, where one ton equals 12,000 BTUs.

To keep compressor discharge temperatures lower and compressor superheat lower when the AV 1 is engaged, the TXV refrigerant transport by-pass line 12 may be configured to permit full refrigerant flow through the by-pass line 12 in an unobstructed manner. In such a system design, the pin restrictor 13 may be eliminated and a solenoid valve 28 may be used instead. In lieu of a solenoid valve 28, a pressure valve, a temperature valve, or the like, may be used so long as the refrigerant 3 flow through the by-pass line 12 is unrestricted when the AV 1 is engaged, and the refrigerant flow through the by-pass line 12 was fully closed off when the AV 1 was disengaged (such as when the temperature of the refrigerant 3 exiting the sub-surface geology is approximately fifty degrees F. Here, both a pin restrictor 13 and a solenoid valve 28 are shown as optional alternatives. However, only one of the pin restrictor 13 and the solenoid valve 28 is typically used.

An AV equalizer line 18 may extend from the AV 1 to the primary low pressure liquid refrigerant transport line 5. Here, the AV 1 is shown as feeding hot refrigerant gas into the primary low pressure liquid refrigerant transport line 5 at a low pressure delivery point 4 that is downstream of both the TXV 7 and the cool liquid refrigerant by-pass line 12. In some embodiments, the delivery point 4 may be at least approximately 2 inches downstream of both the TXV 7 and the cool liquid refrigerant by-pass line 12. Additionally, the delivery point 4 may be positioned at least approximately 2 inches, and in some embodiments at least approximately 12 inches, upstream of the AV equalizer line entry point 19 into the primary low pressure liquid refrigerant transport line. It will be appreciated that the low pressure delivery point 4 is also upstream of a distributor 20 to the interior heat exchanger 6. The terms "downstream" and "upstream" are used herein according to the direction of refrigerant flow for the current mode of operation of the system (i.e., heating mode or cooling mode).

In such a design, where the hot gas by-pass line 2 has a low pressure liquid line delivery point 4 that is prior to the distributor 20, a dry nitrogen pressure installation line 15 is shown for charging the cap 16 of the AV 1 with a specific dry nitrogen charge of approximately 85 psi, when one of an R-410A and an R-407C refrigerant is utilized, to offset the valve spring adjustment when the AV 1, if adjustable as is the valve identified below, is equivalent to the valve identified below with its adjustable screw 17 in a fully clockwise position. A suitable adjustable AV 1 may be a Sporlan Valve HGBE-5-95/115, as manufactured by the Sporlan Division of the Parker Hannifin Corporation, of 206 Lange Drive, Washington, Mo. 63090. Other valves may be utilized that have similar operational equivalencies.

The automatic hot gas by-pass valve/AV 1 disclosed herein may be provided with hot refrigerant gas exiting an oil separator (not shown), after exiting the compressor (not shown) and an oil separator that is at least ninety-eight percent efficient may be incorporated into the system design. Compressors and oil separators are well understood by those skilled in the art.

Although not shown herein, an electronically controlled valve, which is well understood by those skilled in the art, could be substituted in lieu of the automatic hot gas by-pass valve 1, also referred to herein as the AV 1, so long as the operative pressure settings disclosed herein are programmed in and utilized.

Figure 2:
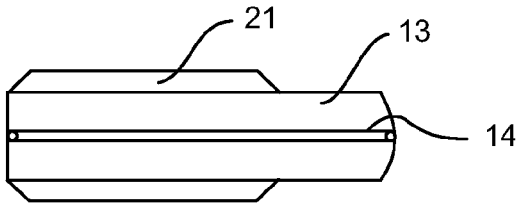
FIG. 2 is a side view of a pin restrictor.

FIG. 2 is a side view of a common pin restrictor 13. The pin restrictor 13 includes a central orifice 14 and fins 21. The fins 21 and central orifice 14 both permit refrigerant flow around and through the pin restrictor 13 when the system is operating in a reverse mode, (which in the current embodiment would be the heating mode).

Figure 3:
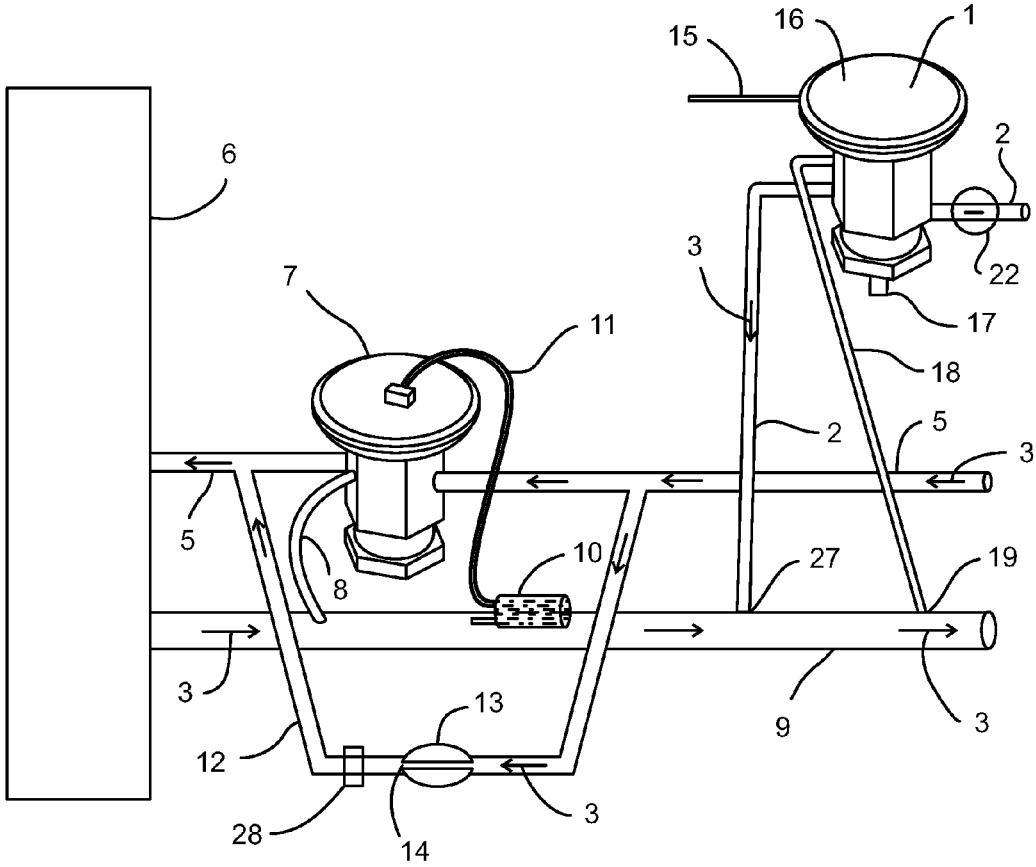
FIG. 3 is a side view of a partial DX geothermal heating/cooling system, primarily showing an interior air handler, refrigerant transport lines, and valves, incorporating primary automatic valve, TXV, and TXV by-pass line teachings of the present disclosures where hot gas is introduced into the warm vapor refrigerant transport line after the refrigerant has exited the air handler, but before the refrigerant is sent to the accumulator and compressor.

FIG. 3 is a side view, not drawn to scale, of an automatic self-adjusting hot gas by-pass valve 1 (also referred to as an "AV") that is situated in a smaller hot gas by-pass refrigerant transport line 2. The hot gas by-pass line 2 carries refrigerant (flowing in the direction of arrows 3) originating from the compressor (not shown), through an oil separator to the AV 1.

The size of the hot gas by-pass line 2 is no larger than that of a portion of the liquid refrigerant transport line 5 extending between the compressor (not shown) and the interior heat exchanger 6, and is no smaller than half the size of that portion of the liquid refrigerant transport line 5.

A check valve 22 (shown here in an open position) is disposed in the hot gas by-pass line 2 between the compressor (not shown) and the AV 1, so as to provide a safety measure to prevent refrigerant 3 flow through the hot gas by-pass line 2 when the system is operating in the heating mode, although the AV 1 itself would normally prevent such flow.

In the cooling mode, the refrigerant traveling through the hot gas by-pass line 2 passes through the AV 1, which automatically meters the flow of the hot gas refrigerant 3 for delivery, at a vapor line delivery point 27 into the primary warm vapor refrigerant transport line 9 exiting the interior heat exchanger 6 (herein shown as an air handler 6).

Additionally, a thermostatically controlled self-adjusting expansion valve 7 (also known as a "TEV" and a "TXV"), is disposed in the primary cool liquid refrigerant transport line 5. In the cooling mode in a DX system design, the primary cool liquid refrigerant transport line 5 carries refrigerant coming from the sub-surface heat exchanger, which sub-surface heat exchanger acts as the condenser in the cooling mode. The cool liquid refrigerant transport line 5 carries cool liquid refrigerant 3 both to the TXV 7 and to a pin restrictor 13 situated within a cool liquid refrigerant by-pass line 12. After passing through the TXV 7 and pin restrictor 13, the pressure and temperature of the refrigerant 3 within the cool liquid refrigerant transport line 5 is reduced, and the refrigerant 3 is thereafter transported to an interior heat exchanger 6 by means of a primary low pressure liquid refrigerant transport line 5. The refrigerant 3 gains heat within the interior heat exchanger 6, and is then transported out of the interior heat exchanger 6, by means of a primary warm vapor refrigerant transport line 9, to an accumulator (not shown) and to a compressor (not shown).

The TXV 7 has a TXV equalizer line 8, which is attached to, and senses the pressure within, the primary warm vapor refrigerant transport line 9 exiting the interior heat exchanger 6. The TXV 7 also has a temperature sensing bulb 10, which bulb 10 is also attached to, and senses the temperature within, the primary warm vapor refrigerant transport line 9 exiting the interior heat exchanger 6, which bulb 10 is operably connected via a connecting line 11 to the TXV 7.

Here, however, a cool liquid refrigerant by-pass line 12 is shown by-passing and traveling around the TXV 7. The cool liquid refrigerant by-pass line 12 contains a pin restrictor 13 with a central orifice 14, which orifice 14 meters the refrigerant 3 flow through the cool liquid by-pass line 12 around the TXV 7. The central orifice 14 within the pin restrictor 13 is sized to have a cross-sectional area of approximately 0.000082 square inches per 1,000 BTUs of system compressor capacity size in BTUs, where 12,000 BTUs equal one ton of compressor capacity size.

An AV equalizer line 18 extends from the AV 1 to the primary warm vapor refrigerant transport line 9. Here, the AV 1 is shown as feeding hot refrigerant 3 gas into the primary warm vapor refrigerant transport line 9 at a vapor line delivery point 27 that is downstream of the interior heat exchanger 6. The vapor line delivery point 27 may be at least approximately 2 inches downstream of the interior heat exchanger. Additionally, the vapor line delivery point 27 may be at least approximately 2 inches, and in some embodiments at least approximately 12 inches, upstream of the AV equalizer line 18 entry point 19 into the primary warm refrigerant transport line 9 that leads to the system's accumulator (not shown) and compressor (not shown).

In such a design where the hot gas refrigerant 3 is supplied to refrigerant 3 exiting the interior heat exchanger 6, where the hot gas by-pass line 2 has a warm vapor refrigerant transport line 9 delivery point 27 that is downstream of the interior heat exchanger 6 but upstream of the accumulator (not shown) and compressor (not shown), and where a TXV 7 has at least one of a TXV bleed port and a TXV by-pass line 12 containing a pin restrictor 13, with the bleed port and/or the pin restrictor 13 permitting only a specified amount of refrigerant 13 to pass through a certain sized opening/orifice 14 (as described above), the AV's 1 cap 16 may be specially charged with a certain pressure of dry nitrogen. A dry nitrogen pressure installation line 15 is shown for use in charging the cap 16 of the AV 1 with a specific dry nitrogen charge of approximately 110 psi, when at least one of an R-410A refrigerant and an R-407C refrigerant is utilized, so as to offset the valve spring adjustment when the AV 1, if adjustable, is equal or equivalent to the valve identified below, with the adjustable screw 17 at the base of the below identified valve example screwed in fully clockwise. As an example, a suitable adjustable AV 1 would be a Sporlan Valve HGBE-5-95/115, as manufactured by the Sporlan Division of the Parker Hannifin Corporation, of 206 Lange Drive, Washington, Mo. 63090. Other valves, similar to the AV 1 described herein, may be utilized that have the same operational equivalencies. In this particular design, the solenoid, or the like, valve 28, as also depicted in the by-pass line 12, may be eliminated.

Alternatively, in a design where the hot gas refrigerant is supplied to refrigerant exiting the interior heat exchanger 6, where the hot gas by-pass line 2 has a warm vapor refrigerant transport line 9 delivery point 27 that is downstream of the interior heat exchanger 6 but upstream of the accumulator (not shown) and compressor (not shown), and where a TXV 7 has a TXV by-pass line 12 without any refrigerant 3 flow restriction, the AV's 1 cap 16 may be specially charged with another certain pressure of dry nitrogen. A dry nitrogen pressure installation line 15 is shown for use in charging the cap 16 of the AV 1 with a specific dry nitrogen charge of approximately 85 psi, plus or minus approximately 5 psi, when at least one of an R-410A refrigerant and an R-407C refrigerant is utilized, so as to offset the valve spring adjustment when the AV 1, if adjustable, is equal or equivalent to the valve identified below, with the adjustable screw 17 at the base of the below identified valve example screwed in fully clockwise. As an example, a suitable adjustable AV 1 would be a Sporlan Valve HGBE-5-95/115, as manufactured by the Sporlan Division of the Parker Hannifin Corporation, of 206 Lange Drive, Washington, Mo. 63090. Other valves may be utilized that have the same operational equivalencies. In this particular system design, the by-pass line 12 would not utilize a pin restrictor 13, but, instead, a solenoid valve 28, or the like, would be installed so as to permit full refrigerant 3 flow through the by-pass line 12 when the AV 1 was engaged and operating, but so as to completely block and stop the refrigerant 3 flow through the by-pass line 12 when the AV 1 was not in operation (i.e., not engaged).

The AV 1 disclosed herein may be provided with hot refrigerant gas exiting an oil separator (not shown), after exiting the compressor (not shown), and an oil separator may be provided that is at least 98% efficient.

Although not shown herein, an electronically controlled valve, which is well understood by those skilled in the art, could be substituted in lieu of the automatic valve, or AV 1, so long as the operative pressure settings disclosed herein are programmed in and utilized.

Figure 4:
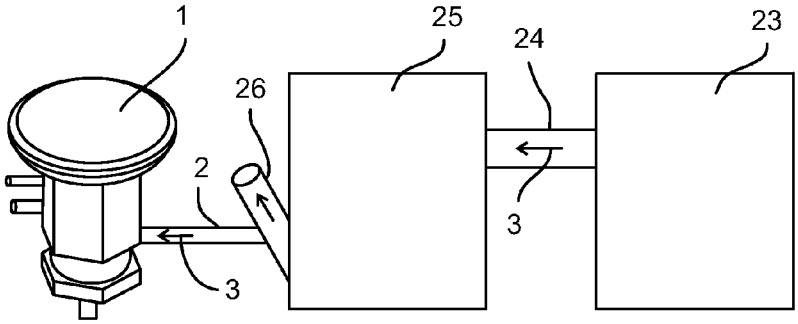
FIG. 4 is a side view of a compressor, an oil separator, and a hot gas by-pass valve, where the hot gas to the valve exits an oil separator.

FIG. 4 is a side view of a compressor 23, with a primary hot refrigerant gas and oil discharge line 24, which line 24 sends refrigerant and oil into an oil separator 25. The oil separator 25 removes most of the oil from the hot refrigerant gas and then sends the mostly hot refrigerant gas, via the oil separator's 25 mostly hot refrigerant gas transport line 26, into the rest of the system.

A hot gas by-pass refrigerant transport line 2 is operably coupled to the mostly hot gas refrigerant transport line 26 exiting the oil separator 25. The hot gas by-pass refrigerant transport line 2 is designed to deliver hot refrigerant gas to an automatic hot gas by-pass valve 1, as more fully described and explained in FIG. 1, and in FIG. 3, hereinabove.

If an oil separator 25 is not provided in the system, the hot gas by-pass line 2 may be operably connected to the primary hot refrigerant gas and oil discharge line 24 from the system's compressor 23.

What is claimed is:

1. A direct exchange geothermal heating/cooling system configured for operation in a cooling mode, comprising:

an interior heat exchanger;

a liquid refrigerant transport line coupled to the interior heat exchanger and configured to direct liquid refrigerant into the interior heat exchanger;

a vapor refrigerant transport line coupled to the interior heat exchanger and configured to direct vapor refrigerant out of the interior heat exchanger;

an expansion valve disposed in the liquid refrigerant transport line;

a hot gas bypass line communicating with the liquid refrigerant transport line at a delivery point and configured to transport vapor refrigerant to the liquid refrigerant transport line, the delivery point being positioned between the expansion valve and the interior heat exchanger; and an automatic valve disposed in the hot gas bypass line and movable between an open position and a closed position, the automatic valve being responsive to an incoming refrigerant temperature entering the liquid refrigerant transport line upstream of the expansion valve to move to the closed position when the incoming refrigerant temperature is above approximately 50 degrees F. and to move to the open position when the incoming refrigerant temperature is below approximately 50 degrees F.

2. The system of claim 1, in which the automatic valve further includes a pressure sensing cap fluidly coupled to an entry point located along the liquid refrigerant transport line by an automatic valve equalizer line, wherein the entry point is at least two inches downstream of the delivery point.

3. The system of claim 2, in which the entry point is at least twelve inches downstream of the delivery point, and in which the delivery point is at least two inches downstream of the expansion valve.

4. The system of claim 2, in which the pressure sensing cap is filled with a charge of dry nitrogen having a pressure of approximately 85 psi, plus or minus approximately 5 psi.

5. The system of claim 4, in which the refrigerant comprises at least one of R-410A refrigerant and R-407C refrigerant.

6. The system of claim 1, further comprising an expansion valve bypass having an inlet fluidly communicating with the liquid refrigerant transport line upstream of the expansion valve and an outlet fluidly communicating with the liquid refrigerant transport line downstream of the expansion valve.

7. The system of claim 6, in which the expansion valve bypass includes a passageway having a cross sectional area equal to approximately 0.000082 square inches times each 1,000 BTUs of system capacity.

8. The system of claim 7, in which the expansion valve bypass comprises one of a TXV bleed port and a TXV bypass line.

9. The system of claim 6, in which the expansion valve bypass comprises a bypass line that is no larger than a size of the liquid refrigerant transport line and is no smaller than ½ the size of the liquid refrigerant transport line.

10. The system of claim 6, in which the expansion valve bypass comprises a bypass line, the system further comprising a bypass valve disposed in the bypass line and movable between an open position and a closed position, the bypass valve being responsive to the incoming refrigerant temperature to move to the closed position when the incoming refrigerant temperature is above approximately 50 degrees F. and to move to the open position when the incoming refrigerant temperature is below approximately 50 degrees F.

11. The system of claim 1, further comprising a check valve disposed in the hot gas bypass line.

12. The system of claim 1, in which the hot gas bypass line is no larger than a size of the liquid refrigerant transport line and is no smaller than ½ the size of the liquid refrigerant transport line.

13. The system of claim 1, further comprising an oil separator coupled to an inlet of the hot gas bypass line, the oil separator being at least 98% efficient.

14. A direct exchange geothermal heating/cooling system configured for operation in a cooling mode, comprising:

an interior heat exchanger;

a liquid refrigerant transport line coupled to the interior heat exchanger and configured to direct liquid refrigerant into the interior heat exchanger;

a vapor refrigerant transport line coupled to the interior heat exchanger and configured to direct vapor refrigerant out of the interior heat exchanger;

an accumulator fluidly coupled to the vapor refrigerant transport line downstream of the interior heat exchanger;

an expansion valve disposed in the liquid refrigerant transport line;

a hot gas bypass line communicating with the vapor refrigerant transport line at a vapor line delivery point and configured to transport vapor refrigerant to the vapor refrigerant transport line, the vapor line delivery point being positioned between the interior heat exchanger and the accumulator; and an automatic valve disposed in the hot gas bypass line and movable between an open position and a closed position, the automatic valve being responsive to an incoming refrigerant temperature entering the liquid refrigerant transport line upstream of the expansion valve to move to the closed position when the incoming refrigerant temperature is above approximately 50 degrees F. and to move to the open position when the incoming refrigerant temperature is below approximately 50 degrees F.

15. The system of claim 14, in which the automatic valve further includes a pressure sensing cap fluidly coupled to an entry point located along the vapor refrigerant transport line by an automatic valve equalizer line, wherein the entry point is at least two inches downstream of the vapor line delivery point.

16. The system of claim 15, in which the vapor line delivery point is at least two inches downstream of the interior heat exchanger.

17. The system of claim 16, in which the entry point is at least 12 inches downstream of the vapor line delivery point.

18. The system of claim 15, further comprising an expansion valve bypass having an inlet fluidly communicating with the liquid refrigerant transport line upstream of the expansion valve and an outlet fluidly communicating with the liquid refrigerant transport line downstream of the expansion valve.

19. The system of claim 18, in which the expansion valve bypass comprises one of a TXV bleed port and a TXV bypass line including a pin restrictor.

20. The system of claim 19, in which the TXV bleed port or pin restrictor defines a passageway having a cross sectional area equal to approximately 0.000082 square inches times each 1,000 BTUs of system capacity.

21. The system of claim 20, in which the pressure sensing cap is filled with a charge of dry nitrogen having a pressure of approximately 110 psi, plus or minus approximately 5 psi.

22. The system of claim 18, in which the expansion valve bypass comprises an unrestricted bypass line and a bypass valve disposed in the unrestricted bypass line, the bypass valve being movable between an open position and a closed position and responsive to the incoming refrigerant temperature to move to the closed position when the incoming refrigerant temperature is above approximately 50 degrees F. and to move to the open position when the incoming refrigerant temperature is below approximately 50 degrees F.

23. The system of claim 22, in which the pressure sensing cap is filled with a charge of dry nitrogen having a pressure of approximately 85 psi, plus or minus 5 psi.

24. The system of claim 14, further comprising a check valve disposed in the hot gas bypass line.

25. The system of claim 14, in which the hot gas bypass line is no larger than a size of the liquid refrigerant transport line and is no smaller than ½ the size of the liquid refrigerant transport line.

26. The system of claim 14, further comprising an oil separator coupled to an inlet of the hot gas bypass line, the oil separator being at least 98% efficient.

* * * * *